US006095131A

United States Patent [19]

Huang

[11] Patent Number: 6,095,131

[45] Date of Patent: Aug. 1, 2000

[54] COMPACT GAS RANGE

[76] Inventor: Fan-Ming Huang, 11 Lane 18, Mei man Street, See Tun District, Taichung, Taiwan

[21] Appl. No.: 09/225,720

[22] Filed: Jan. 6, 1999

[51] Int. Cl.[7] ..... F24C 5/20

[52] U.S. Cl. ..... 126/38; 126/39 R

[58] Field of Search ..... 126/39 R, 38

[56] References Cited

U.S. PATENT DOCUMENTS 5,070,858 12/1991 Wang ..... 126/38

5,890,887 4/1999 Adler ..... 126/38

*Primary Examiner*—Carroll Dority

*Attorney, Agent, or Firm*—Rabin & Champagne, P.C.

[57] ABSTRACT

A compact gas range has a gas storage slot formed between an upper circular cover and a lower circular seat. The gas storage slot is divided by two partitions into three chambers. The two partitions are provided with a valve piece having a valve hole and a filtration core disposed in the valve hole. When the ignition switch is turned on, the liquid form gas is allowed to enter the first chamber. The liquid form gas is then filtered and transformed into a gas form gas which enters the second chamber via the valve hole of the second partition. The gas form gas is completely vaporized in the third chamber so as to bring about a complete combustion. The lower circular seat is provided with a gas replenishing hole and a tube which is provided therein with a ring and a guide having a hole. The ring is capable of urging the joint of a gas can to avert the gas leak. The hole of the guide seat is capable of guiding the joint of the gas can such that the joint of the gas can is coaxial with the tube of the lower circular seat, so as to prevent the gas leak.

2 Claims, 7 Drawing Sheets

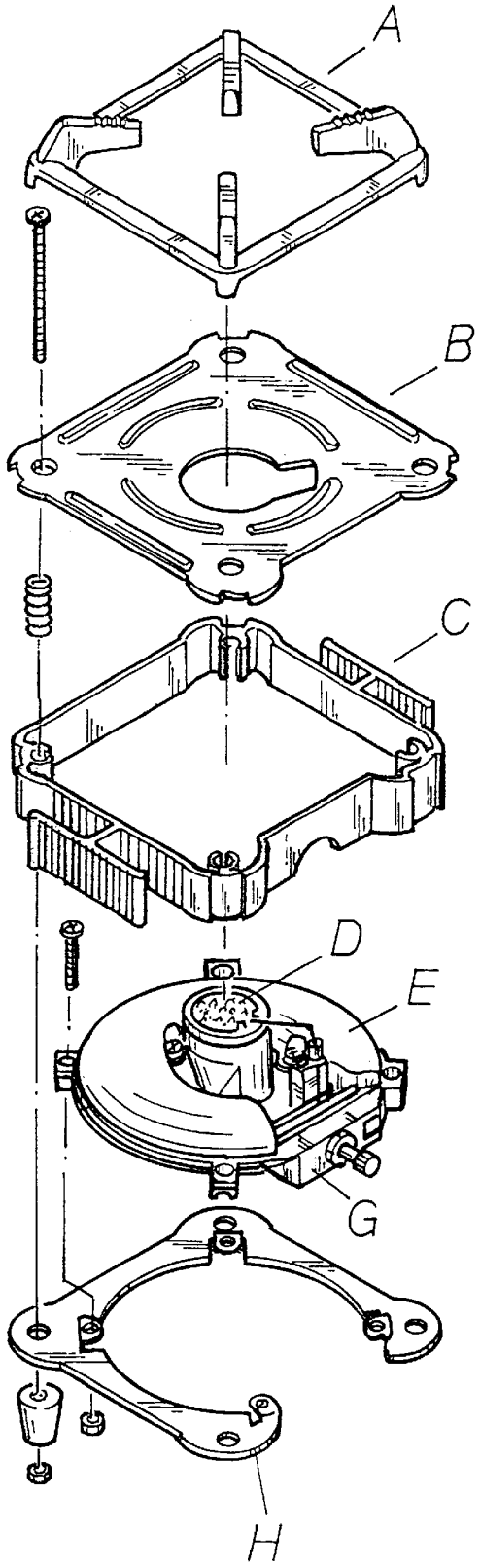
FIG.1-A

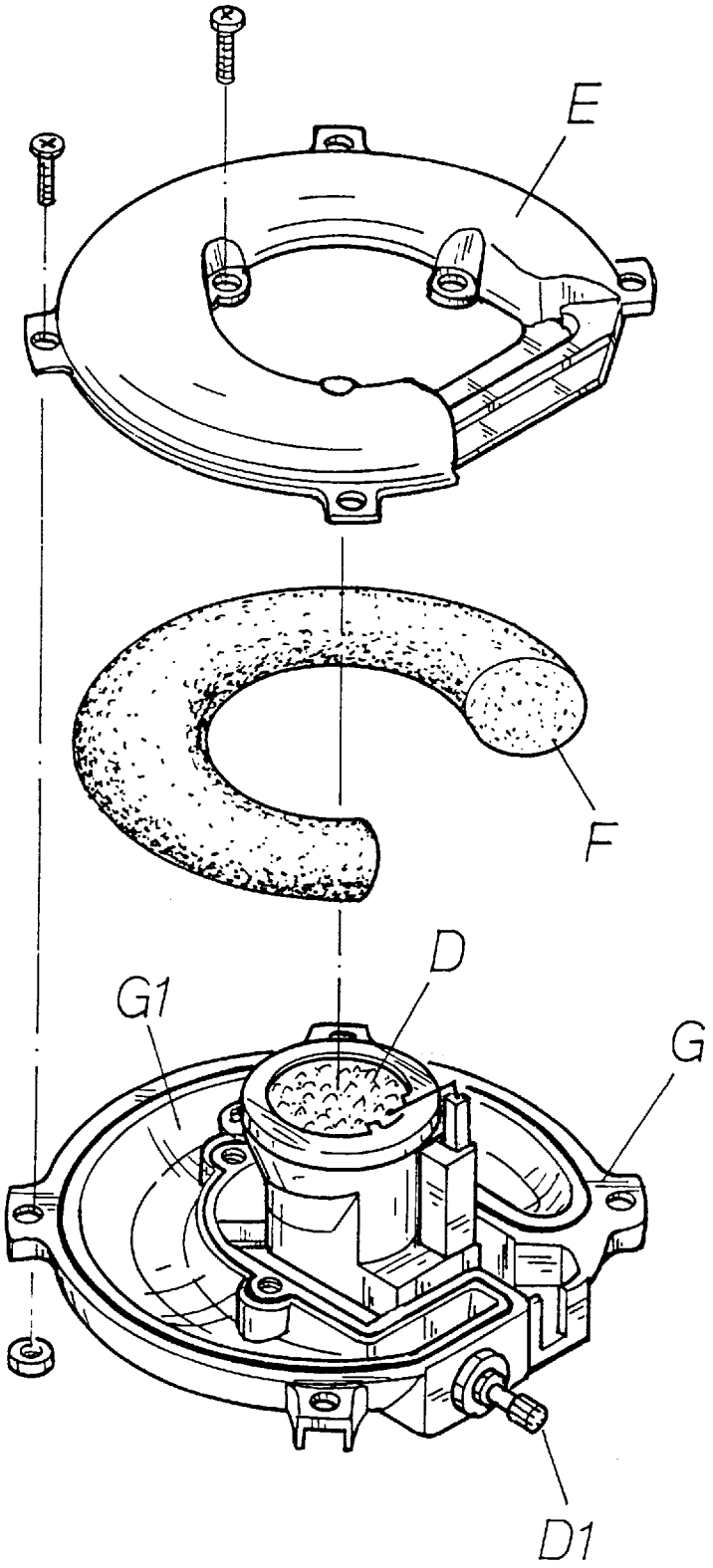
FIG.1-B

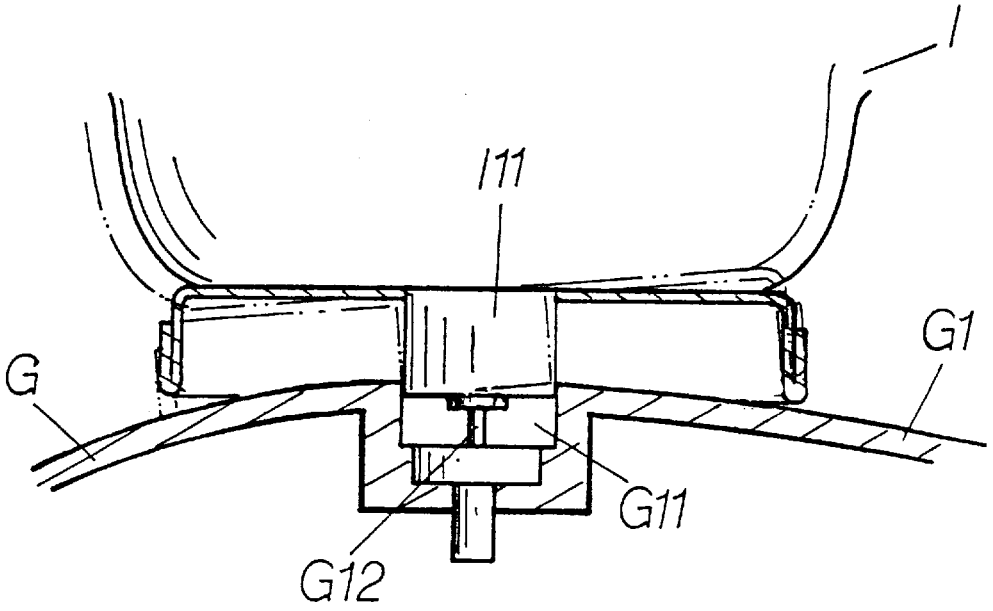
FIG. 1-C
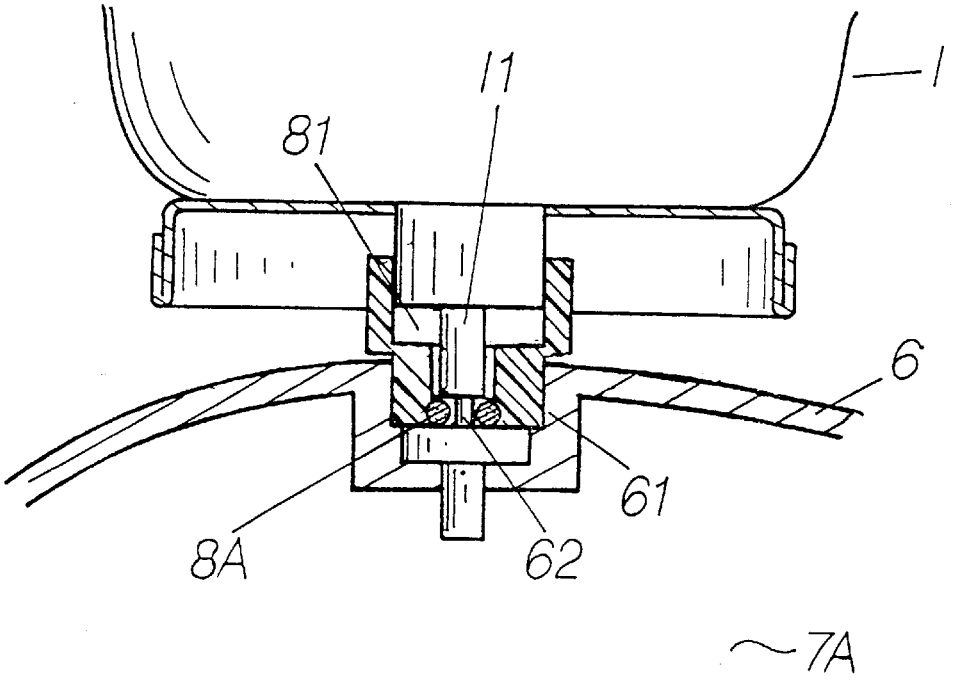
FIG. 6-B

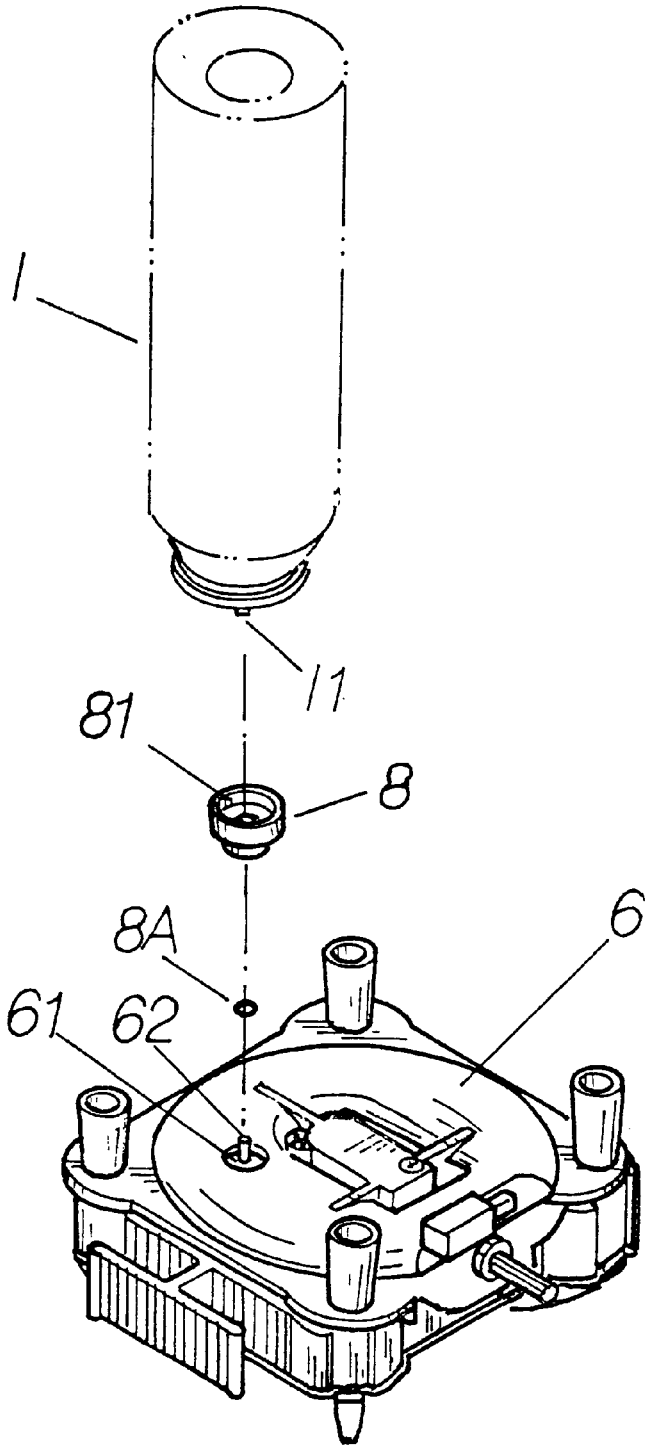
FIG. 6-A

COMPACT GAS RANGE

FIELD OF THE INVENTION

The present invention relates generally to a gas range, and more particularly to a compact gas range.

BACKGROUND OF THE INVENTION

As shown in FIGS. 1A, 1B and 1C, a compact gas range of the prior art is composed of a support frame A, a fastening piece B, a protective frame C, a combustion seat D, a circular cover E, an absorbing cotton F, a gas container seat G, and a fastening ring H. The absorbing cotton F is made of polyvinyl alcohol and is used to absorb the gas contained in the gas container G1. The gas absorbed by the absorbing cotton F is transformed into the liquid form. When the ignition switch D1 of the combustion seat D is turned on, the liquid form is transformed into the gas form for combustion. Such a transformation of the liquid form into the gas form is often incomplete such that an incomplete combustion takes place. The incomplete combustion of gas form is often incomplete such that an incomplete combustion takes place. The incomplete combustion of gas is harmful to one's health, especially if the incomplete combustion of gas takes place in a closed compartment. In addition, the prior art compact gas range is vulnerable to gas leak at the time when the gas container G1 is replenished with gas. As shown in FIG. 1C, the gas inlet G11 is defective in design in that it often fails to remain perpendicular to the tube G12, as indicated by the imaginary lines in FIG. 1C. As a result, the compact gas range of the prior art is not only a health hazard but also a fire hazard.

SUMMARY OF THE INVENTION

It is therefore the primary objective of the present invention to provide an improved compact gas range which is free from the shortcomings of the prior art compact gas range described above.

In keeping with the principle of the present invention, the foregoing objective of the present invention is attained by the compact gas range which is provided with a gas storage slot. The gas storage slot is divided by two partitions into three chambers which are respectively provided with a valve piece having a tiny hole. In light of the three chambers, the gas can be completely vaporized to result in a complete combustion.

In addition, the gas storage slot of the compact gas range of the present invention is provided with a lower circular seat which is in turn provided with a gas replenishing hole. The gas replenishing hole is provided therein with a tube which is in turn provided with a soft ring and a guide seat capable of assisting the tube to remain perpendicular to the joint of a gas can at the time when the gas can is replenished with gas. The gas leak is thus averted.

The foregoing objective, features, functions, and advantages of the present invention will be more readily understood upon a thoughtful deliberation of the following detailed description of a preferred embodiment of the present invention with reference to the drawings provided herewith.

BRIEF DESCRIPTION OF THE DRAWINGS

FIG. 1A shows a perspective view of a compact gas range of the prior art.

FIG. 1B shows an enlarged exploded view of a portion of the compact gas range of the prior art.

FIG. 1C shows a schematic view of the gas replenishing operation of the compact gas range of the prior art.

FIG. 6A shows a schematic view of the gas replenishing operation of the preferred embodiment of the present invention.

FIG. 6B shows a schematic view of the structures and the installation position of the preferred embodiment of the present invention.

DETAILED DESCRIPTION OF THE EMBODIMENT

Figure 2:
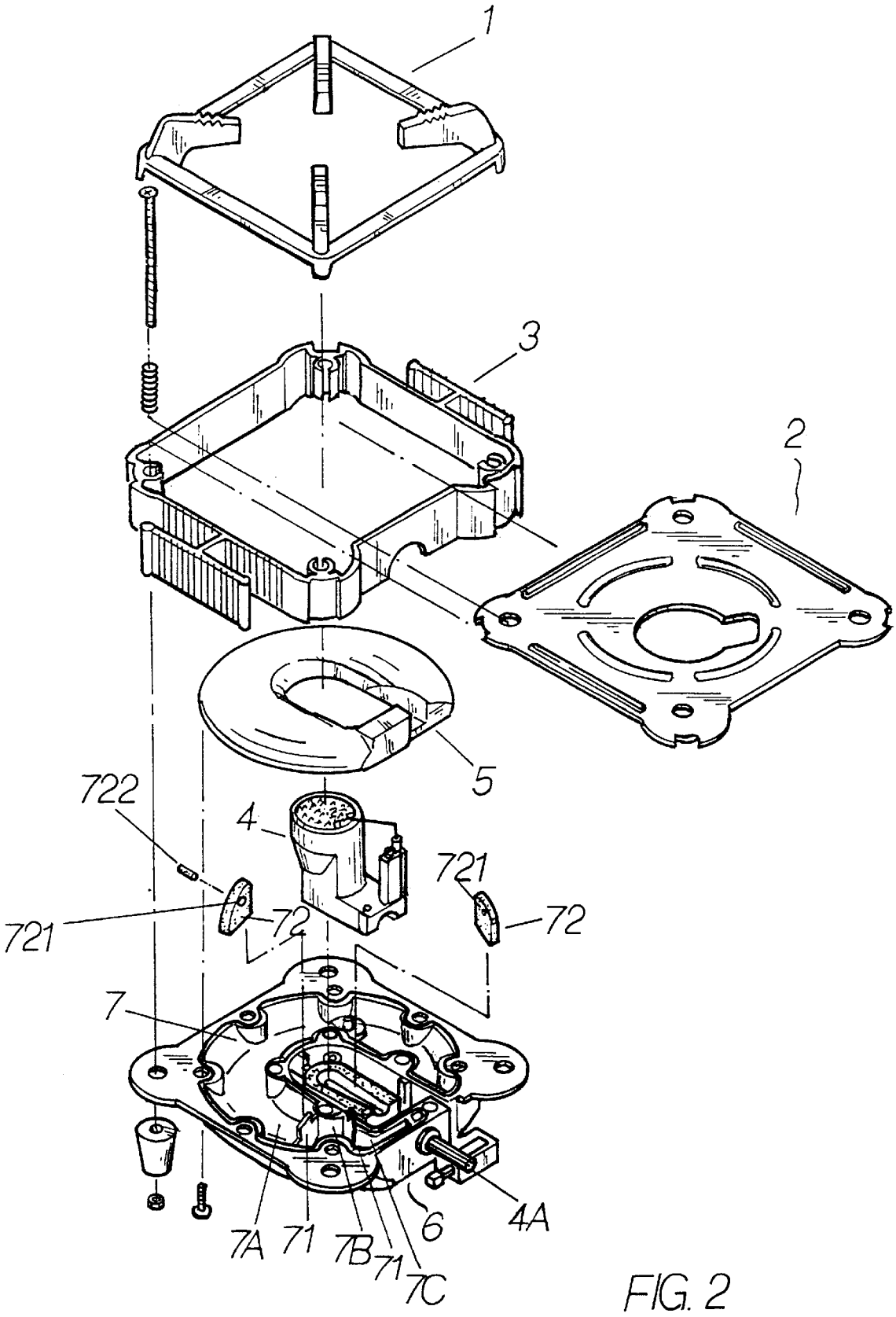
FIG. 2 shows an exploded view of a compact gas range of the preferred embodiment of the present invention.
Figure 3:
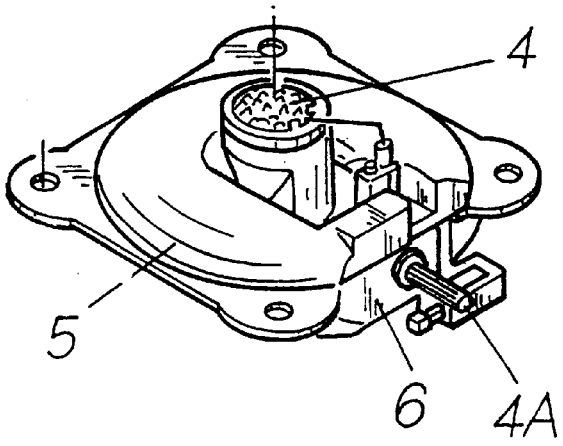
FIG. 3 shows a partial schematic view of the preferred embodiment of the present invention in combination.
Figure 4:
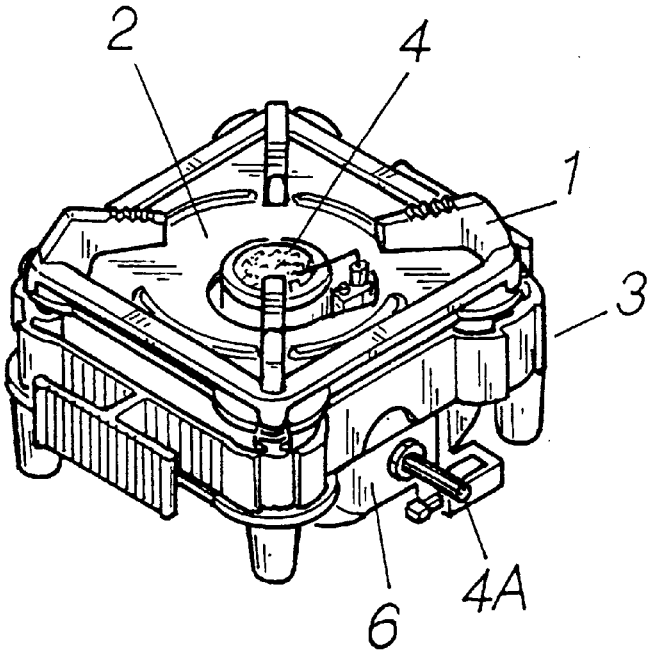
FIG. 4 shows a perspective view of the preferred embodiment of the present invention.

As shown in FIGS. 2–5, a compact gas range embodied in the present invention is composed of a utensil support frame 1, a fastening piece 2, a protective frame 3, a combustion seat 4, an upper circular cover 5 of a gas storage slot, and a lower circular seat 6 of the gas storage slot.

Figure 5:
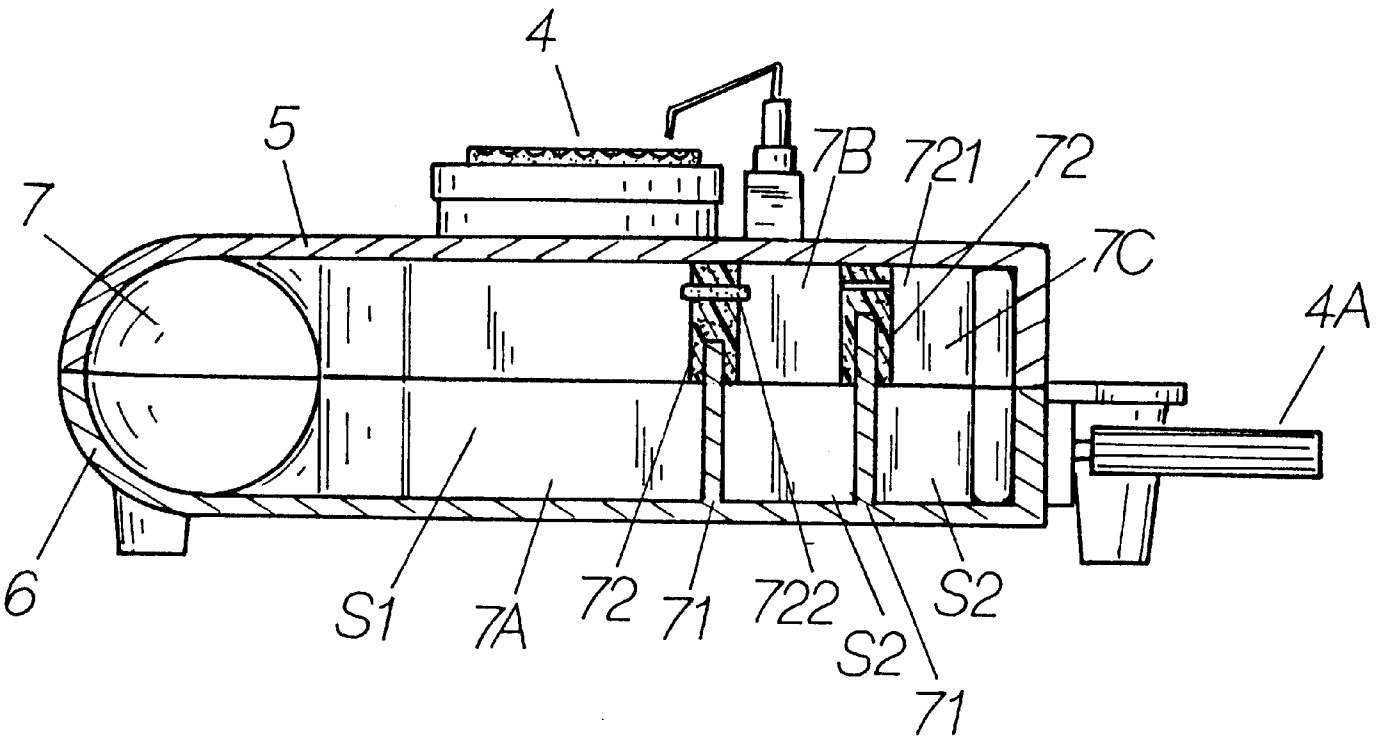
FIG. 5 shows a sectional view of the preferred embodiment of the present invention in combination.

The compact gas range of the present invention is characterized in design in that it is provided with a gas storage slot 7 which is formed between the upper circular cover 5 and the lower circular seat 6 and is provided with two partitions 71. The gas storage slot 7 is divided by the two partitions 71 into three chambers 7A, 7B and 7C. The two partitions 71 are respectively provided with a valve piece 72 having a tiny valve hole 721 in which a columnar filtration core 722 is provided. The liquid form gas S1 in a gas can I is allowed to enter the chamber 7A before ignition is started. When an ignition switch 4A of the combustion seat 4 is turned on, the liquid form gas S1 passes through the valve hole 721 of the valve piece 72 of one of the two partitions 71 such that the gas is filtered by the filtration core 722, and that the liquid form gas S1 is transformed into the gas form gas S2, which disperses into the middle chamber 7B, as shown in FIG. 5. In order to prevent the occurrence of the residual liquid form gas S1, the gas form gas S2 is once again passed through the valve hole 721 of the valve piece 72 of other one of the two partitions 71 such that a complete vaporization of the gas S2 takes place in the chamber 7C, as shown in FIG. 5. The gas S2 is mixed thoroughly with air in the chamber 7C such that the gas form gas S2 is burned completely. As a result, there will be no incident of incomplete combustion.

As shown in FIGS. 6A and 6B, the lower circular seat 6 of the present invention is provided with a gas replenishing hole 61 and a tube 62 which is provided therein with a soft O ring 8A and a guide seat 8 having a hole 81. When the replenishing hole 61 and the tube 62 are in contact with the joint I1 of a gas can I, the joint I1 of the gas can I is urged by the O ring 8A to avert the gas leak. In addition, the hole 81 of the guide seat 8 serves to guide the joint I1 of the gas can I such that the joint I1 and the tube 62 are coaxial.

The embodiment of the present invention described above is to be deemed in all respects as being merely illustrative and not restrictive. Accordingly, the present invention may be embodied in other specific forms without deviating from the spirit thereof The present invention is therefor to be limited only by the scopes of the following appended claims.

What is claimed is:

1. A compact gas range comprising a utensil support frame, a fastening piece, a protective frame, a combustion seat having an ignition switch, and a gas storage slot; wherein said gas storage slot is formed between an upper circular cover and a lower circular seat and provided with two partitions which divide said gas storage slot into three chambers, said two partitions being provided with a valve piece having a valve hole and a filtration core disposed in said valve hole, a liquid form gas being allowed to enter the first chamber and pass said valve hole of said valve piece of one of said two partitions at the time when the ignition switch of the combustion seat is turned on, the liquid form gas being filtered by said filtration core before being transformed into a gas form gas which disperses into the second chamber and passes through said valve hole of said valve piece of other one of said two partitions such that a complete vaporization of the gas form gas takes place in the third chamber, so as to bring about a complete combustion of the gas form gas.

2. The compact gas range as defined in claim 1, wherein said lower circular seat is provided with a gas replenishing hole and a tube which is provided therein with a ring and a guide seat having a hole, said ring capable of urging the joint of a gas can to avert a gas leak, said hole of said guide seat capable of guiding the joint of the gas can such that the joint of the gas can is coaxial with said tube of said lower circular seat, so as to prevent the gas leak.

* * * * *